United States Patent [19]

Tsong-Chi

[11] Patent Number: 4,847,947

[45] Date of Patent: Jul. 18, 1989

[54] BASE FOR SETTING A HINGE

[76] Inventor: Lin Tsong-Chi, 146, Min Chyuan Rd., TaFu Village, FuNe Shiang, Kaohsiung Hsien, Taiwan

[21] Appl. No.: 197,201

[22] Filed: May 23, 1988

[30] Foreign Application Priority Data

Apr. 11, 1988 [TW] Taiwan ..... 77203438

[51] Int. Cl.[4] ..... E05D 7/04

[52] U.S. Cl. ..... 16/238; 16/235; 16/246; 16/382

[58] Field of Search ..... 16/237, 238, 245, 246, 16/249, 382, DIG. 43, 235, 236, 242; 403/353, 375, 380, 381

[56] References Cited

U.S. PATENT DOCUMENTS

| | | | |
|---|---|---|---|
| 2,583,950 | 1/1952 | Kirschner | 16/238 |
| 4,142,272 | 3/1979 | Oogami et al. | 16/245 |
| 4,712,271 | 12/1987 | Sundermeier | 16/238 |

FOREIGN PATENT DOCUMENTS

| | | | |
|---|---|---|---|
| 2629792 | 1/1978 | Fed. Rep. of Germany | 16/249 |

*Primary Examiner*—Nicholas P. Godici
*Assistant Examiner*—Edward A. Brown
*Attorney, Agent, or Firm*—Larson and Taylor

[57] ABSTRACT

A base for setting a hinge for furniture comprising a carrier plate and a mounting plate assembled together by means of a projection of the carrier plate anchoring in a groove of the mounting plate. This connection limits the carrier plate to move only minutely along the groove of the mounting plate.

3 Claims, 5 Drawing Sheets

BASE FOR SETTING A HINGE

BACKGROUND OF THE INVENTION

This invention concerns a base for setting a hinge for furniture on which is, mounted the hinge arm of the hinge for fixing up or attaching the hinge on the side wall of an article of furniture. In order to allow the door of an article of furniture to turn around in opening or closing, a hinge is usually used to link and support the door to turn in relation to the side wall of the article of furniture.

For the assembling convenience and the opening smoothness, it is necessary to adjust minutely the height of the base in order to keep the tightness of both, the hinge and the base against the door, as the structure of the U.S. Pat. No. 4,367,566 does.

SUMMARY OF THE INVENTION

This invention aims to furnish a base for setting a hinge that can be minutely adjusted in its height so that the hinge can be fixed properly on the door of an article of furniture.

This base for setting a hinge in accordance with the present invention comprises a mounting plate provided with a groove in one side of its bottom and a hole for receiving a bolt after the bolt has penetrated through an elliptic hole of a carrier plate. This carrier plate has a longitudinal groove provided with a projection at one side for anchoring in the groove of the mounting plate and a notch at the other for a third leg of the mounting plate to extend out. The carrier plate and the mounting plate are assembled together to make up this base, the carrier plate can be moved minutely in relation to the mounting plate so that the height of the base can be adjusted so as to keep the hinge tightly set on the door of an article of furniture.

BRIEF DESCRIPTION OF THE DRAWINGS

An embodiment of the invention will now be described by way of example and with reference to the accompanying drawings, in which.

DETAILED DESCRIPTION OF THE INVENTION

Figure 1:
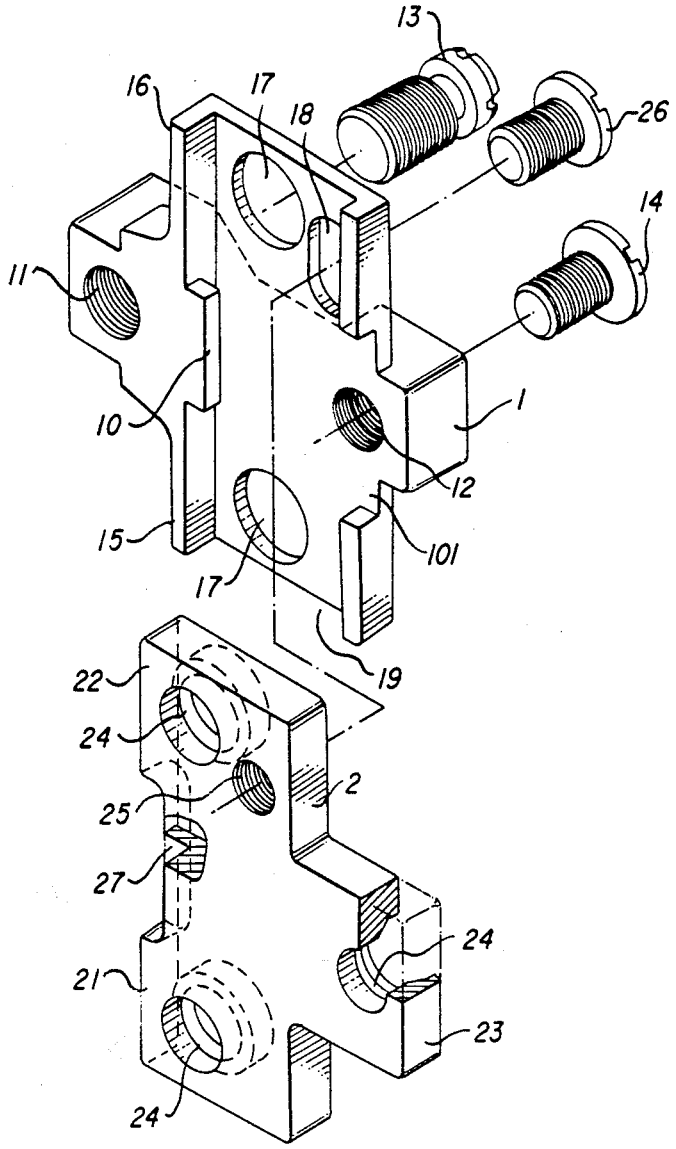
FIG. 1 is an exploded perspective view of the base for setting a hinge in accordance with the present invention.

As shown in FIG. 1, this base for setting a hinge includes a carrier plate 1 and a mounting plate 2.

Figure 2:
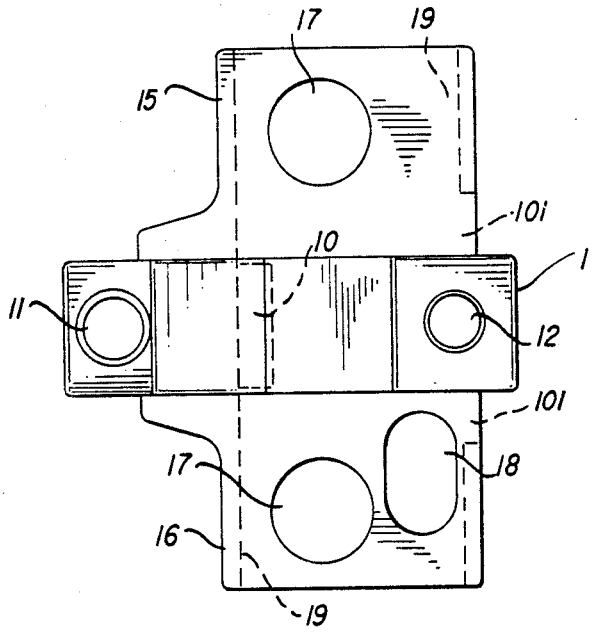
FIG. 2 is an top view of the carrier plate in accordance with the present invention.
Figure 3:
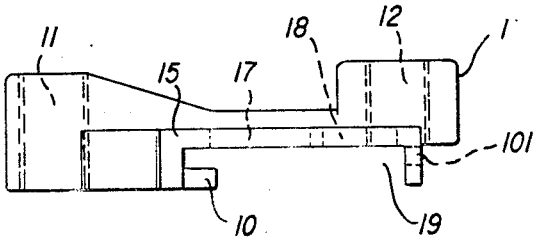
FIG. 3 is a front view of the carrier plate in accordance with the present invention.

The carrier plate 1, with reference to FIGS. 1, 2 and 3 has two screw holes 11, 12 at two sides of its transverse center axis for bolts 13, 14 to screw in and to anchor a hinge arm (not shown). Besides, the carrier plate 1 is provided with two wings 15, 16 located vertically to the transverse axis, said wing 15 bored with a hole 17 and said wing 16 bored with a hole 17, and an oval hole 18. In addition, the face of the carrier plate 1 is provided with a longitudinal groove 19 having a projection 10 at one side and a notch 101 at the other.

Figure 4:
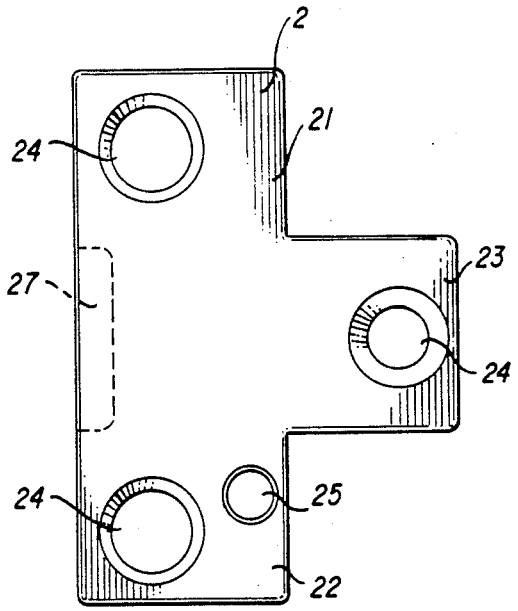
FIG. 4 is an top view of the mounting plate in accordance with the present invention.
Figure 5:
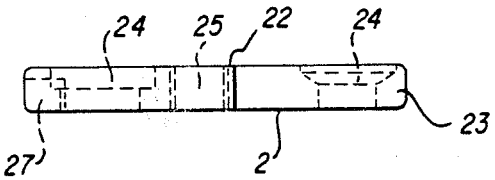
FIG. 5 is a front view of the mounting plate in accordance with the present invention.

The mounting plate 2, as shown in FIGS. 1, 4 and 5, has a first leg 21 and a second leg 22 extending in a longitudinal direction and having a width enabling them just to fit in the groove 19 of the carrier plate 1. The mounting plate 2 also has a third leg 23 extending to one side. All the three legs 21, 22 and 23 have respectively a flat head bolt hole 24 for a flat head bolt to fix the mounting plate 2 on the side wall of an article of furniture. The second leg 22 is additionally provided with a hole 25 for a bolt 26 to screw in. The bottom of the mounting plate 2 has a groove 27.

Figure 6:
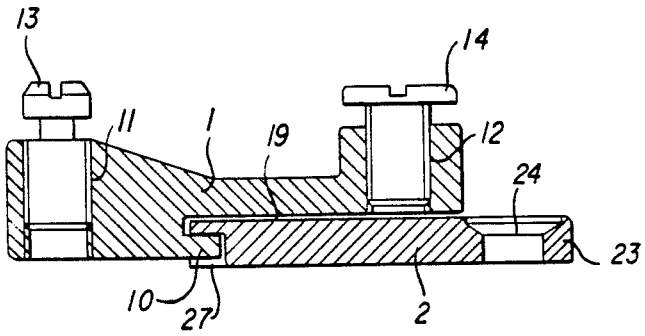
FIG. 6 is a cross-sectional view taken along line 6—6 of FIG. 7.
Figure 7:
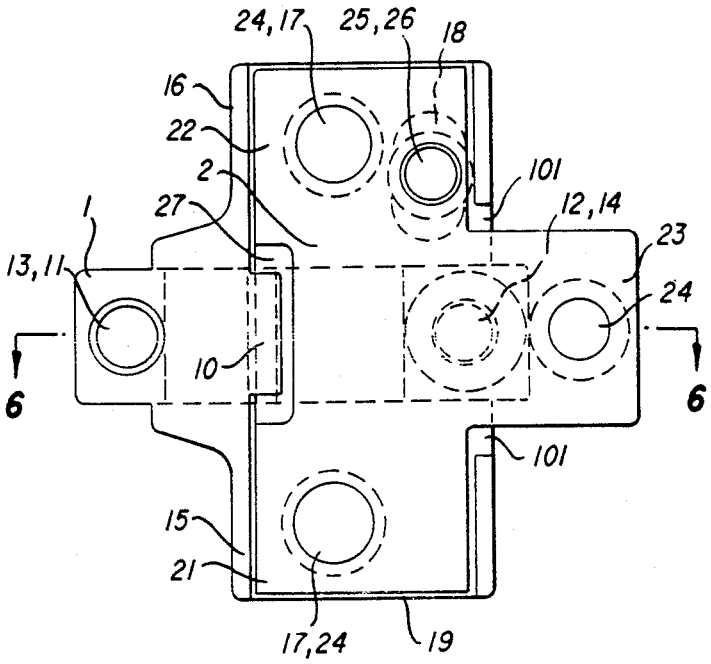
FIG. 7 is a bottom view of the base assembled in accordance with the present invention.
Figure 8:
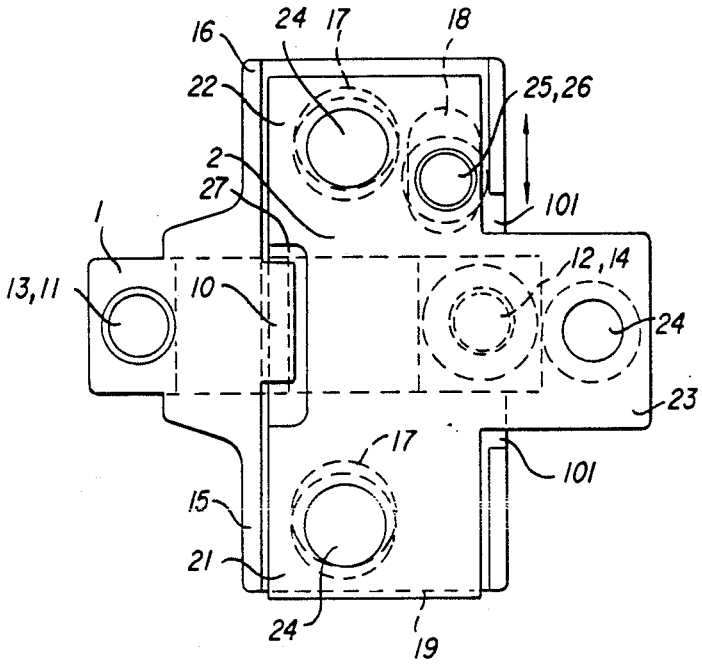
FIG. 8 is a view of mutual movement of the carrier plate and the mounting plate after they are assembled with each other in accordance with the present invention.

In FIGS. 6 and 7, by anchoring the projection 10 of the carrier plate 1 in the groove 27 of the mounting plate 2 and the third leg 23 in the notch 101, the carrier plate 1 can be assembled and overlapped with the mounting plate 2. Then, by means of the bolt 26 inserting through the elliptic hole 18 to screw in the hole 25 in the mounting plate 2, the carrier plate 1 can be tightly assembled together and overlapped with the mounting plate 2, and by means of the bolt 26 inserting through. But, as shown in FIG. 8, the carrier plate 1 can be moved along the mounting plate 2 in the longitudinal direction when bolt 26 is loosened somewhat.

Before anchoring the carrier plate 1 with the mounting plate 2, the mounting plate 2 must first be fixed up on the side wall of an article of furniture by bolting the flat head bolts in the flat head bolt hole 24, and then the carrier plate 1 is combined with the mounting plate 2. And finally, the bolts 13, 14 are respectively screwed in the holes 11, 12 for setting the hinge.

In general, the micro adjustability the carrier plate 1 has enables a hinge to be set accurately and conveniently on the door and the side wall of an article of furniture.

What is claimed is:

1. A base for setting a hinge to a furniture comprising:

a mounting plate having a mounting top face, a mounting bottom face and two longitudinal mounting sides, said mounting plate including (a) flat head bolt holes in which bolts are received to affix said mounting plate to the furniture with said mounting bottom face engaging the furniture, (b) a mounting groove provided in a portion of said mounting bottom face and along a portion of one said longitudinal mounting sides such that said mounting top face covers said mounting groove, (c) a mounting threaded bolt hole, and (d) a mounting leg extending from the other said longitudinal mounting side at a same longitudinal position as said mounting groove;

a carrier plate having a carrier top face, a carrier bottom face, and two longitudinal carrier sides, said carrier plate including (a) a longitudinal carrier groove provided between said longitudinal carrier sides such that said carrier groove longitudinally slidingly receives said mounting plate, (b) a projection into said longitudinal carrier groove from one said longitudinal carrier side, said projection being received in said mounting groove and underneath said mounting top face when said mounting plate is received in said carrier groove, (c) a notch provided from said carrier groove through the other said longitudinal carrier side, said notch receiving said mounting leg therein when said mounting plate is received in said carrier groove, and (d) an elliptic hole which overlies said threaded bolt hole when said mounting plate is received in said carrier groove; and a threaded bolt which engages said carrier top face and which passes through said elliptic hole to be received in said mounting threaded bolt hole whereby when said threaded bolt is loosened said carrier plate is slidable relative to said mounting plate and when said threaded bolt is tightened said carrier plate is fixed to said mounting plate.

2. A base for setting a hinge as claimed in claim 1, wherein said carrier plate has two hinge holes for bolts to screw in so as to connect a hinge arm of the hinge to said carrier plate.

3. A base for setting a hinge as claimed in claim 2 wherein said two hinge holes are provided at a same longitudinal position as said projection and on respective lateral sides of said carrier plat, and wherein said elliptic hole is provided to one side of a line connecting said hinge holes.

* * * * *